US008381478B2

(12) United States Patent
Leach et al.

(10) Patent No.: US 8,381,478 B2
(45) Date of Patent: Feb. 26, 2013

(54) RETAINING WALL BLOCK

(75) Inventors: Keith Leach, Abbotsford (CA); Benoit Slavinski, St-Basile-Le-Grand (CA)

(73) Assignee: ACP Manufacturing, Ltd., Abbotsford, British Columbia (CA)

( * ) Notice: Subject to any disclaimer, the term of this patent is extended or adjusted under 35 U.S.C. 154(b) by 0 days.

(21) Appl. No.: 12/925,970

(22) Filed: Nov. 3, 2010

(65) Prior Publication Data

US 2011/0162314 A1 Jul. 7, 2011

(30) Foreign Application Priority Data

Nov. 3, 2009 (CA) ..... 2684275

(51) Int. Cl.
*E04B 5/04* (2006.01)

(52) U.S. Cl. ..... 52/606; 52/302.4; 52/503; 52/574; 52/604; 52/608

(58) Field of Classification Search ..... 52/574, 52/302.4, 604, 606, 607, 608, 609, 503–505
See application file for complete search history.

(56) References Cited

U.S. PATENT DOCUMENTS

| | | | | |
|---|---|---|---|---|
| 1,374,955 | A * | 4/1921 | Schenk | 52/608 |
| 1,394,406 | A * | 10/1921 | Elnathan | 52/302.4 |
| 1,862,246 | A * | 6/1932 | Ticehurst | 52/608 |
| 2,137,153 | A * | 11/1938 | Brozek | 52/574 |
| 2,634,118 | A * | 4/1953 | Jantsch | 165/9.3 |
| 3,956,862 | A * | 5/1976 | Alexandre, Jr. | 52/286 |
| 4,182,089 | A * | 1/1980 | Cook | 52/284 |
| 4,372,091 | A * | 2/1983 | Brown et al. | 52/592.6 |
| 4,802,320 | A | 2/1989 | Forsberg | 52/585.1 |
| 4,815,897 | A | 3/1989 | Risi et al. | 405/284 |
| 4,982,544 | A | 1/1991 | Smith | 52/606 |
| 5,145,288 | A | 9/1992 | Borcherdt | 405/284 |

(Continued)

FOREIGN PATENT DOCUMENTS

CA 2 355 010 A1 10/2002

OTHER PUBLICATIONS

Allan Block Corporation, "What makes Allan Block the Best Designed Mortarless Retaining Wall Black on the Market?", Tech Sheet #897, © 1997, 2 pages.

*Primary Examiner* — Brian Glessner
*Assistant Examiner* — Joshua Ihezie
(74) *Attorney, Agent, or Firm* — Harrington & Smith

(57) ABSTRACT

Blocks for wall constructions described herein are in the form of casted one-piece concrete hollow bodies. The blocks include front and back walls which are generally parallel to a first axis and have top and bottom ends and two inner walls integral to both front and back walls therebetween that are generally parallel to a second axis which is perpendicular to the first axis. One of the end side faces of the two inner walls includes male connector portions that are offset from a first distance from the front wall. The other end side face includes female connector portions that are registered along the first axis with the male connector portions and are offset from the first distance from the back wall. The male connector portion is for insertion in the female connector portion of another block when the other block is mounted thereon so as to yield a straight or a shifted retaining wall portion. The shifted retaining wall portion results from the first and second blocks having their front walls on a same side relative to the first axis and the straight retaining wall portion results from the first and second blocks having their front walls on opposite sides relative to the first axis. Further embodiments of the blocks include further female receiving portions allowing versatile positioning of the blocks.

8 Claims, 10 Drawing Sheets

U.S. PATENT DOCUMENTS

| | | | | | |
|---|---|---|---|---|---|
| 5,161,918 | A | | 11/1992 | Hodel | 405/286 |
| 5,294,216 | A | * | 3/1994 | Sievert | 405/286 |
| 5,484,236 | A | | 1/1996 | Gravier | 405/286 |
| 5,560,172 | A | * | 10/1996 | Brophy et al. | 52/596 |
| 5,619,835 | A | | 4/1997 | Bailey, II et al. | 52/606 |
| 5,622,456 | A | | 4/1997 | Risi et al. | 405/284 |
| 5,623,797 | A | * | 4/1997 | Gravier et al. | 52/284 |
| D381,437 | S | * | 7/1997 | Browning | D25/113 |
| 5,687,531 | A | * | 11/1997 | Nelson et al. | 110/338 |
| 5,816,749 | A | * | 10/1998 | Bailey, II | 405/286 |
| 5,822,939 | A | * | 10/1998 | Haener | 52/405.2 |
| 5,826,395 | A | * | 10/1998 | Weaver | 52/606 |
| 5,894,702 | A | * | 4/1999 | Stenekes | 52/606 |
| 6,024,516 | A | | 2/2000 | Taylor et al. | 405/262 |
| 6,082,067 | A | | 7/2000 | Bott | 52/592.3 |
| 6,089,792 | A | * | 7/2000 | Khamis | 405/262 |
| 6,108,995 | A | * | 8/2000 | Bouchard et al. | 52/609 |
| 6,115,983 | A | * | 9/2000 | Poignard | 52/606 |
| 6,152,655 | A | * | 11/2000 | Hull | 405/286 |
| 6,322,742 | B1 | | 11/2001 | Bott | 264/297.9 |
| 6,490,837 | B1 | | 12/2002 | Dueck et al. | 52/592.6 |
| 6,792,731 | B2 | | 9/2004 | Bott et al. | 52/603 |
| 6,821,058 | B1 | * | 11/2004 | Dawson | 405/284 |
| 6,827,527 | B2 | | 12/2004 | Conkel et al. | 405/284 |
| 6,854,231 | B2 | * | 2/2005 | MacDonald et al. | 52/562 |
| 6,854,236 | B2 | | 2/2005 | Bott | 52/609 |
| 6,912,823 | B2 | * | 7/2005 | MacDonald et al. | 52/574 |
| D516,735 | S | * | 3/2006 | Kees et al. | D25/115 |
| 7,096,634 | B2 | * | 8/2006 | Dean, Jr. | 52/574 |
| 7,114,887 | B1 | * | 10/2006 | Rainey | 405/262 |
| 7,174,687 | B2 | * | 2/2007 | Ferguson | 52/592.6 |
| D540,476 | S | * | 4/2007 | Price | D25/113 |
| 7,207,146 | B1 | | 4/2007 | Morrell | 52/561 |
| D551,361 | S | | 9/2007 | Price | D25/113 |
| 7,360,970 | B2 | * | 4/2008 | Woolford et al. | 405/286 |
| 7,645,098 | B1 | * | 1/2010 | Rainey | 405/284 |
| 7,775,747 | B2 | | 8/2010 | Bott | 405/286 |
| 7,845,885 | B2 | * | 12/2010 | Jaecklin | 405/286 |
| 7,905,070 | B2 | * | 3/2011 | August | 52/604 |
| 2005/0091940 | A1 | * | 5/2005 | Whitson | 52/574 |
| 2009/0116911 | A1 | | 5/2009 | Shaw | 405/284 |

* cited by examiner

RETAINING WALL BLOCK

BACKGROUND

Blocks for the construction of a retaining wall are well known. They conventionally include a face to be exposed and complementary top and bottom faces therebetween to help piling the blocks.

Numerous improvements on the above general concept have been proposed mostly to improve the cooperation of the blocks during piling in order to add stability to the resulting wall or to ease its construction.

However, no known block for retaining walls from the prior art allows selective construction of a wall according to one of a plurality of configuration, such a straight wall and an offset wall.

DETAILED DESCRIPTION

Figure 1:
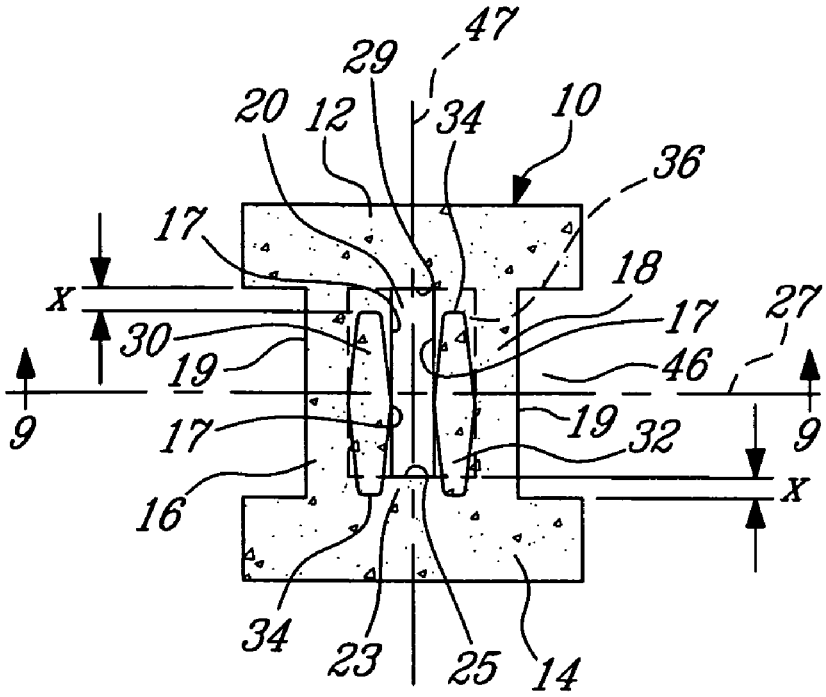
FIG. 1 is top plan view of a retaining wall block according to a first embodiment.

In accordance with an embodiment, there is provided a retaining wall block comprising:

front and back walls generally parallel to a first axis and having top and bottom ends;

two inner walls integral to both front and back walls therebetween and that are generally parallel to a second axis which is perpendicular to the first axis; the two inner walls spacing the front and back walls; the inner walls having facing inner faces, opposite outer faces and a thickness which defines opposite top and bottom end side faces thereof;

each of the top side faces of the inner walls having a projection thereon defining a male connector portion; the male connector portion being offset from a first distance from the front wall; each of the bottom side faces of the inner walls including a projection-receiving portion defining a female connector portion that is registered along the first axis with a respective one of the male connector portions and that is offset from the first distance from the back wall;

the retaining wall block being a first retaining wall block; the male connector portion being for insertion in a respective female connector portion of a second similar retaining wall block when it is mounted onto the retaining wall block so as to yield a straight or a shifted retaining wall portion; the shifted retaining wall portion resulting from the first and second retaining wall blocks having their front walls on a same side relative to the first axis and the straight retaining wall portion resulting from the first and second retaining wall blocks having their front walls on opposite sides relative to the first axis.

According to a more specific embodiment, the back wall includes an abutment between the two inner walls adjacent the bottom end of the back wall; the projection-receiving portions being first projection-receiving portions and the female connector portions being first female connector portions; each of the inner faces of the inner walls defining with the front walls and with the abutment of the back wall a second projection-receiving portion defining a second female connector portion; the male connector portion being further for insertion in the first or second female connector portion of the second similar retaining wall block when it is mounted onto the retaining wall block so as to yield the straight or the shifted retaining wall portion.

According to still another embodiment, each of the outer face of each inner wall defines with the front and back walls therebetween a projection-receiving housing for receiving the projections of a third similar retaining wall block when the third retaining wall block is pivoted 90 degrees about the second axis and mounted adjacent the first retaining wall block in a side-by-side relationship.

In the following description, similar features in the drawings have been given similar reference numerals, and in order not to weigh down the figures, some elements are not referred to in some figures if they were already identified in a precedent figure.

The expressions "top" and "bottom" and "front" and "back", are provided to define relative spatial relationships and therefore should not to be construed in a limited way. Other expressions such as "higher" and "lower" and other similar expressions should also not be construed in a limited way and are also intended to define relative spatial relationships. For example, what will be referred to herein as a top side face of a block becomes the bottom side face when the block is pivoted from 180 degrees.

The use of the word "a" or "an" when used in conjunction with the term "comprising" in the claims and/or the specification may mean "one", but it is also consistent with the meaning of "one or more", "at least one", and "one or more than one". Similarly, the word "another" may mean at least a second or more.

As used in this specification, the words "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, un-recited elements.

Figure 2:
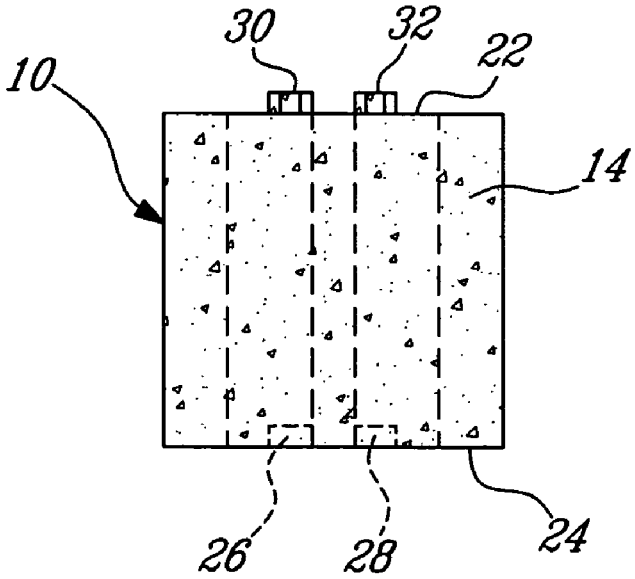
FIG. 2 is front elevation of the block from FIG. 1.
Figure 3:
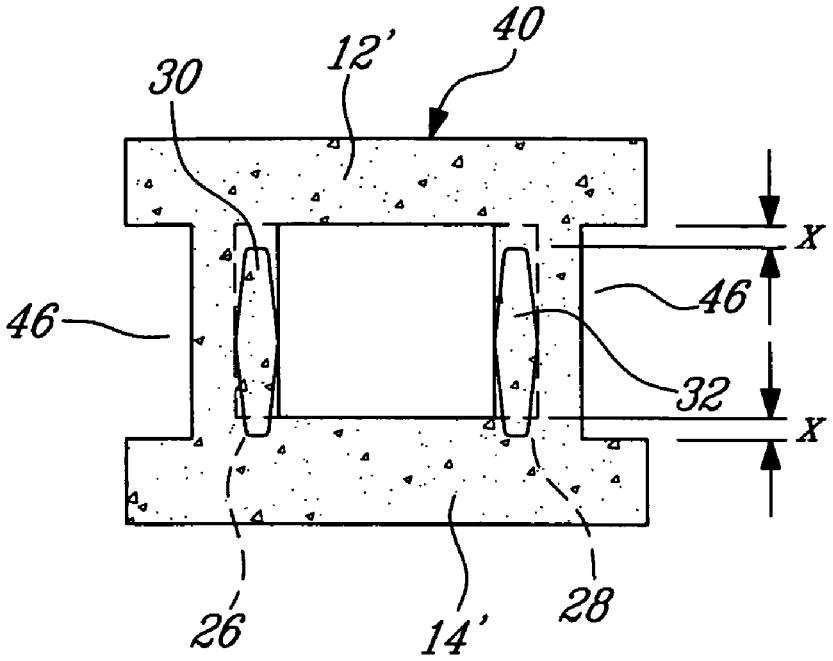
FIG. 3 is top plan view of a retaining wall block according to a second embodiment.
Figure 4:
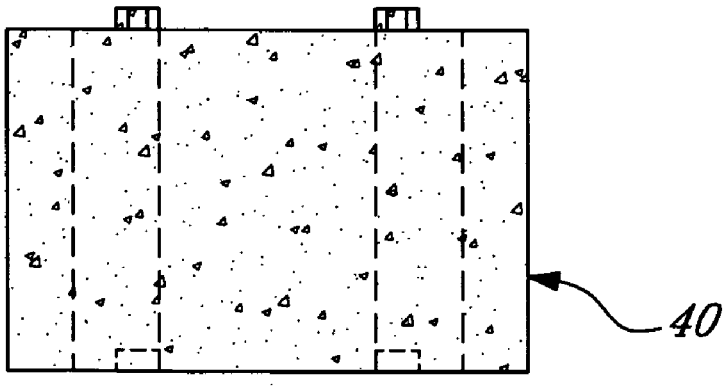
FIG. 4 is front elevation of the block from FIG. 3.
Figure 5:
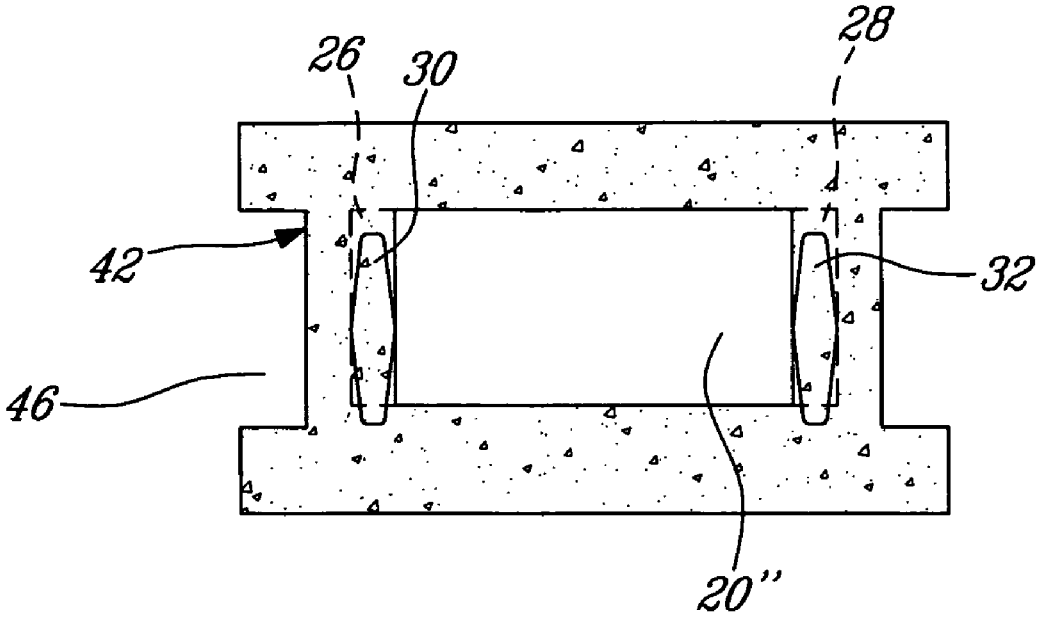
FIG. 5 is top plan view of a retaining wall block according to a third embodiment.
Figure 6:
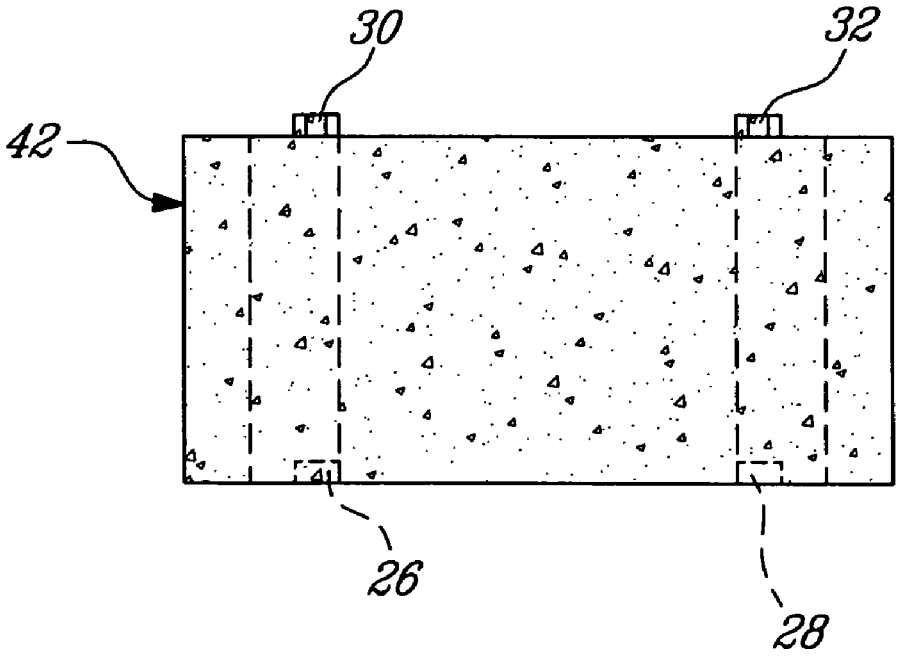
FIG. 6 is front elevation of the block from FIG. 5.
Figure 9:
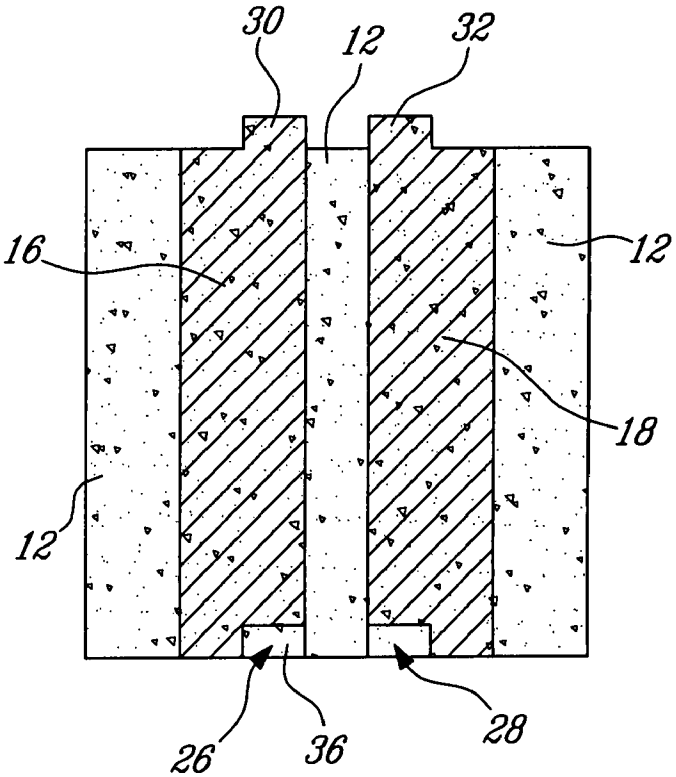
FIG. 9 is cross section taken along line 9-9 in FIG. 1.

Other objects, advantages and features of the present invention will become more apparent upon reading the following non restrictive description of illustrated embodiments thereof, given by way of example only with reference to the accompanying drawings A block 10 for a retaining wall according to a first embodiment will now be described with reference to FIGS. 1, 2 and 9.

The block 10 is in the form of a casted one-piece concrete hollow body defining front and back parallel walls 12 and 14 distanced by first and second parallel inner walls 16 and 18 which are positioned perpendicularly therefrom and which bridge the two outer walls 12 and 14. The first and second inner walls 16 and 18 have the same length. The walls 12, 14, 16 and 18 have substantially the same height defining the top and bottom end sides 22 and 24 of the block 10.

The first and second inner walls 16 and 18 are distanced so as to yield a hollow core 20 therebetween. The walls 16 and 18 are said to be inner since the front and back walls 12 and 14 extend beyond the inner walls 16 and 18 which are not exposed contrarily to at least one of the front and back walls 12 and 14 when the blocks 10 and/or other blocks according to embodiments of the present invention are assembled in a wall configuration.

The front and back walls 12 and 14 are generally parallel to the axis 27. For illustration purposes, the axis 27 intersects the inner walls 16 and 18 at their center and for that reason will be referred to as the center axis 27.

The two inner walls 16 and 18 have facing inner faces 17 and opposite outer faces 19.

The inner faces of the hollow core 20 are defined by the inner faces of the outer and inner walls 12, 14, 16 and 18.

The back wall 14 has a thicker portion between the two inner walls 16 and 18, defining an abutment 23 and yielding a corresponding inner surface 25 which is closer to the center axis 27 than to the opposite surface 29.

The bottom side of the two inner walls 16 and 18 are provided with two shallow rectangular holes 26 and 28 defining female connector portions which open on the hollow core 20. Each of the two female connector portions 26 and 28 spans from the inner surface 25 of the hollow core 20 to the inner surface 29 and therefore has a length equal to the length of the widest side of a section of the hollow core 20 as taken between the top and bottom sides 22 and 24 thereof. The female connector portions 26 and 28 are therefore offset from the back wall 14 from a distance 'x', which is equal to the difference in distance of the inner surfaces 25 and 29 to the center axis 27.

According to a further embodiment (not shown), the female connector portions do not open to the hollow core 20 and are independent therefrom.

The top sides of the two inner walls 16 and 18 are provided with two male connector portions 30 and 32 protruding therefrom. The height of the male connector portions 30 and 32 is substantially equal to the depth of the two shallow holes 26 and 28 and are registered therewith along the axis 27. Moreover, the length of the male connector portions 30 and 32 is generally equal to the length of the female connector portions 26 and 28 for snugly fitting therein. The male connector portions 30 and 32 are offset from the front wall 12 from a distance 'x'.

The two male portions 30 and 32 have an identical hexagonal cross-section, wherein the widest cross section of the male portions 30 and 32 is substantially equal to the width of the female portions 26 and 28 for the aforementioned snugly fitting.

According to further embodiments, the male portions 30-32 have a cross-section which is, without limitations, rounded or rectangular. The cross-section of the male connector portions 30 and 32 can also be irregular.

The length of the outer walls 12 and 14 is such that they extend beyond the inner walls 16 and 18 perpendicularly therefrom defining a pair of wing elements on opposite sides of the block 10. Each pair of wings define a rectangular housing 46 therebetween that can receive the male connector portions 30 and 32 of a second block 10 positioned besides the first block 10 as will be explained hereinbelow in more detail with reference to FIG. 15. The width of the housing 46, i.e. its dimension along an axis 47 parallel to the inner walls, is such that it can receive the male connector portions 30 and/or 32 should they be offset downwardly or upwardly relative to the center axis 27 along the axis 47. More specifically, the width of the housing 46 is equal to the length of the male connector portions 30 and 32 plus the offset value x.

According to a further embodiment (not shown), the inner walls 16 and 18 can have a height different than the front and back walls 12 and 14 as long as the female connector portions 26 and 28 and the male connector portions 30 and 32 can be operatively coupled.

FIGS. 3-4 and FIGS. 5-6 illustrate blocks 40 and 42 for a retaining wall according to respectively second and third embodiments of the present invention. The blocks 10, 40 and 42 only differ in the dimension of their front and back walls 12, 14 and 12' and 14' and more specifically in the width thereof, and, as a result, of their hollow core 20, 20' and 20" respectively.

As discussed hereinabove and as will become more apparent upon reading the following description, a block for a retaining wall according to another embodiment of the present invention may have different configuration and size and also can be used with other blocks according to embodiments of the present invention whose walls have different dimensions.

With references to FIGS. 7, 8, 10A and 10B, the configuration of the blocks 40 allows forming a straight or an offset wall. In the offset wall, each row is offset relative to the adjacent rows, resulting in a wall which is inclined.

Figure 7:
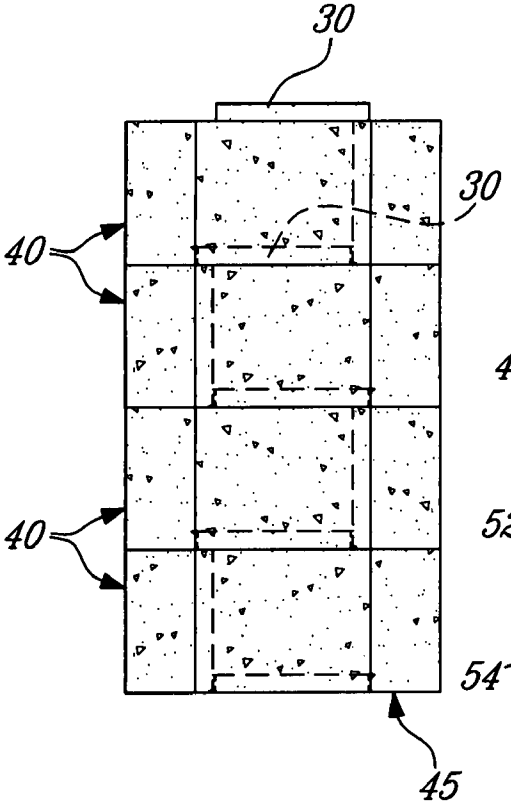
FIG. 7 is a side elevation of a first wall assembly using blocks from FIG. 3, the resulting wall assembly being straight.
Figure 10A:
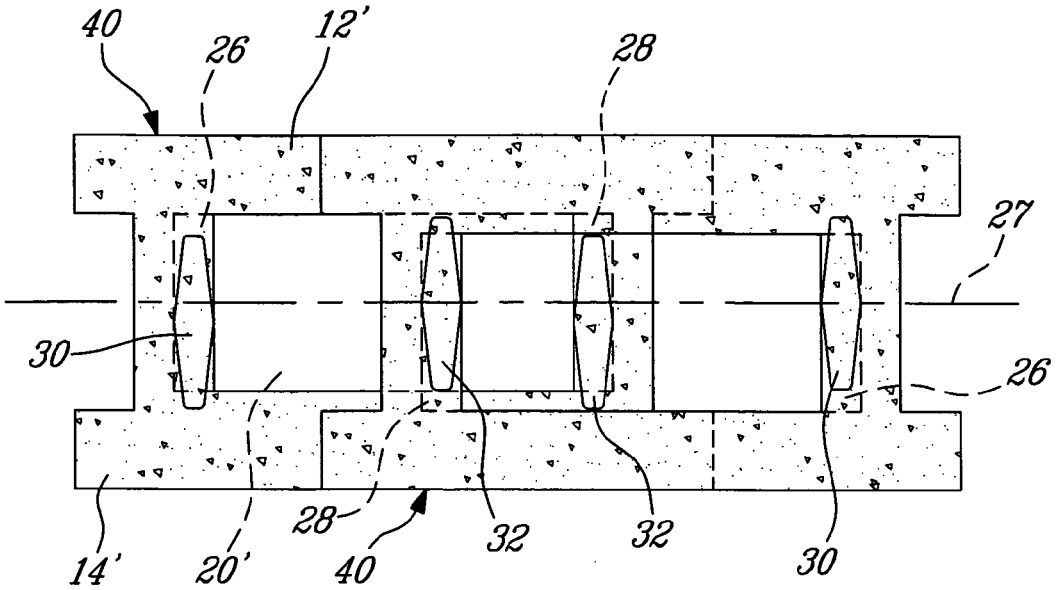
FIG. 10A is a top plan view of the first wall assembly from FIG. 7.

FIGS. 7 and 10A illustrate the stacking of blocks 40 to form a straight wall 45. To achieve such a straight wall construction 45, the blocks 40 are pivoted every other row from 180 degrees so that two adjacent blocks 40 from consecutive rows does not have their front walls 12 on a same side of the axis 27. In other words, a front wall 12 of a block 10 is sandwiched between the back walls 14 of adjacent blocks 10 and vice versa. Along the axis 27, the block 40 is positioned on blocks 40 (or 10 or 42) of the precedent row so that at least one of the male connector portions 30 and/or 32 of the lower block 40 are inserted in one of the female connector portions 26 and 28 of the top block 40 that is in positioned or in the hollow core 20' thereof.

As it will now become apparent from the above teaching, the inner faces 17 of the inner walls 16 and 18 define with the abutment portion 23' a further projection receiving or male connector portion.

The two male connector portions 30 and 32 of a lower block 40 are not automatically inserted in the female connector portions 26 and 28 of the block 40 mounted thereon since blocks from adjacent rows are usually axially shifted so that their longitudinal ends are not aligned or their width are chosen so as to achieved same results.

Figure 13:
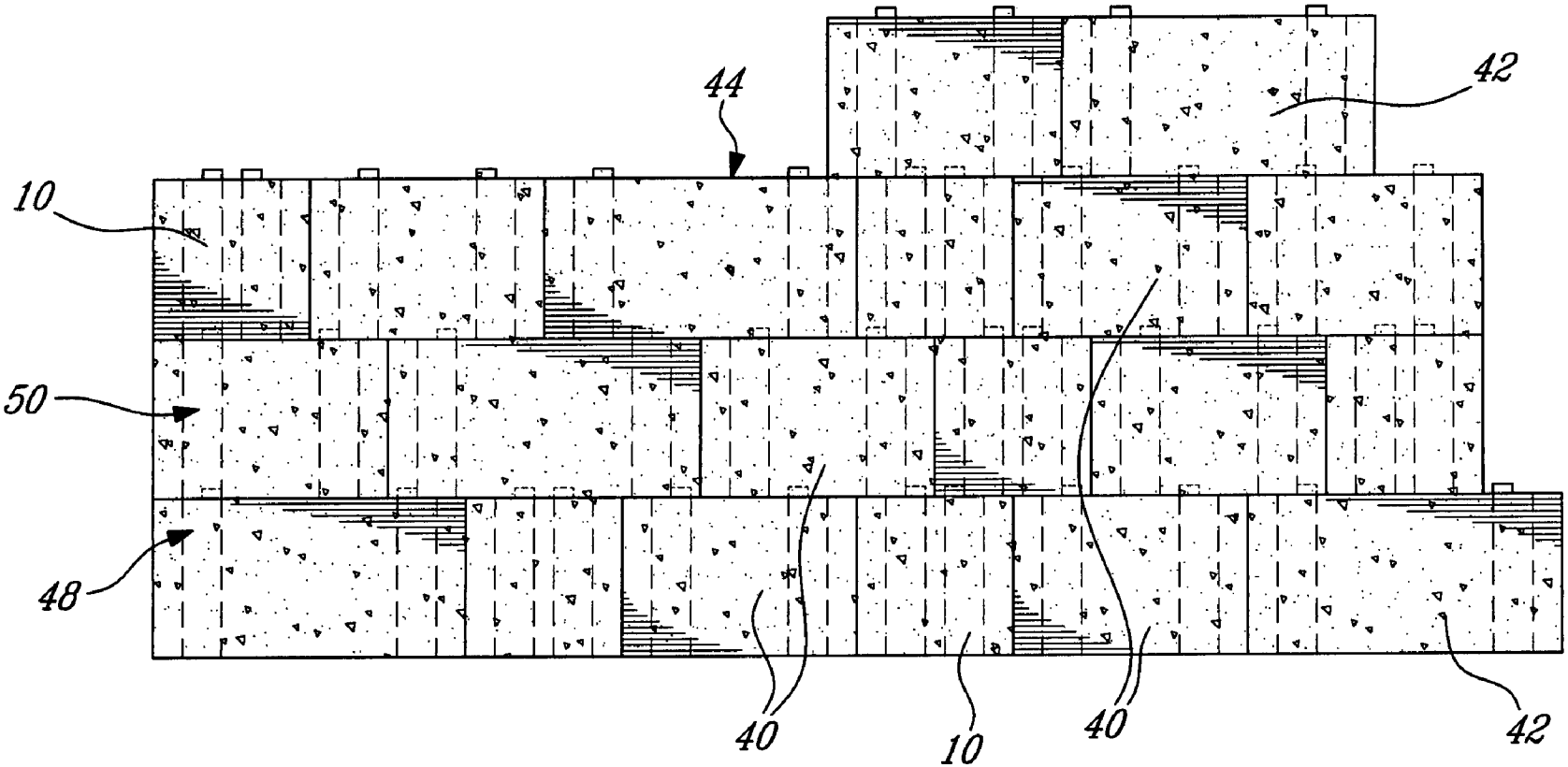
FIG. 13 is a front elevation of the wall assembly from FIG. 7, illustrating the use of blocks from FIGS. 1, 3 and 5.

Indeed, with reference to FIG. 13, in constructing the wall 44, the blocks 10, 40 and 42 are chosen and positioned so as to prevent or limit the occurrence of alignment of the edges of two blocks 10, 40 and/or 42 in adjacent rows. This has been found to result in a wall construction which is more visually appealing. However, providing blocks 10, 40 and 42 with a same height contribute to facilitating the construction of the wall 44. As it will be shown hereinbelow, construction of a wall can also be achieved with blocks having both different width and different height.

To provide a wall construction which is straight on both side, all blocks 40 (or 10 or 42) have the same thickness, which is defined by the distance between the outer faces of the two front and back walls 12' and 14'.

Figure 8:
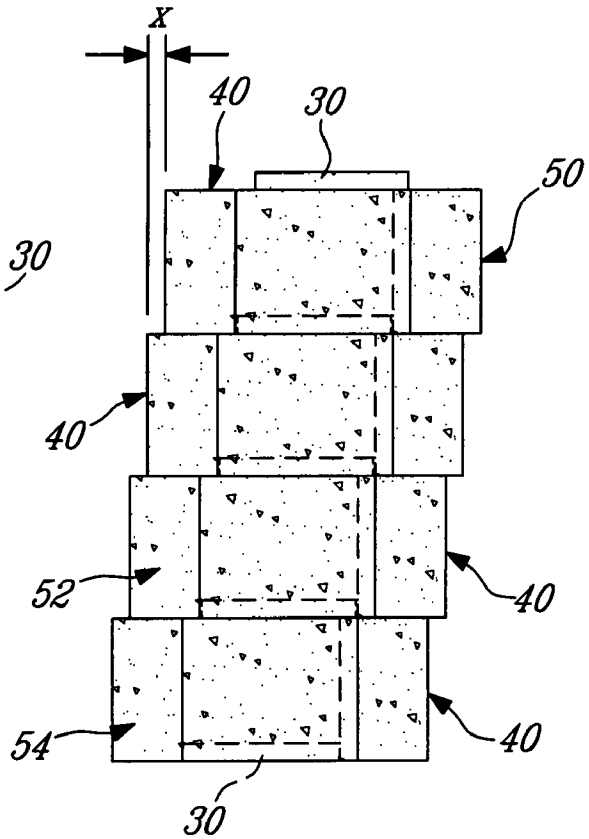
FIG. 8 is a side elevation of a second wall assembly using blocks from FIG. 3, illustrating the front to back offsetting of the blocks.
Figure 10B:
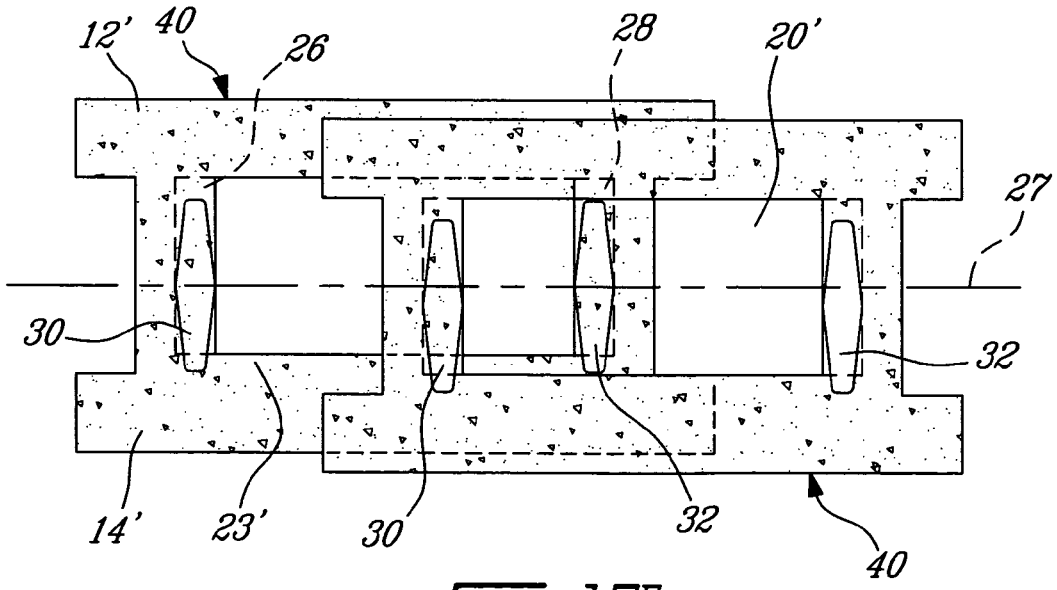
FIG. 10B is a top plan view of the second wall assembly from FIG. 8.

With reference now to FIGS. 8 and 10B, a second wall configuration 50 using blocks 40 will now be described.

Superimposing two blocks 40 so that they have their respective front walls 12 (or back walls 14) abutting and therefore on a same side of the axis 27 results in the wall construction 50 of FIG. 8, wherein two consecutive rows, such as rows 52 and 54, are offset from the distance 'x'.

Similarly to the straight wall construction shown in FIG. 10A, a block 40 is positioned on blocks 40 (or 10 or 42) of the precedent row so that male connector portions 30 and/or 32 thereof are inserted in respective female connector portions 26 and 28 of the block 40 that is in the process of being positioned or in the hollow core 20' thereof. The positioning of a block is therefore the same for the straight and offset configurations with the difference that the different relative position of the male and female connector portions of two adjacent blocks to be superimposed forces the upper block to be aligned or offset relative to the lower block.

Even though the wall constructions 45 and 50 have been described as including identical blocks 40, such constructions may also be achieved using blocks 10, 42, a combination thereof and/or other similar blocks having different sizes.

Figure 11:
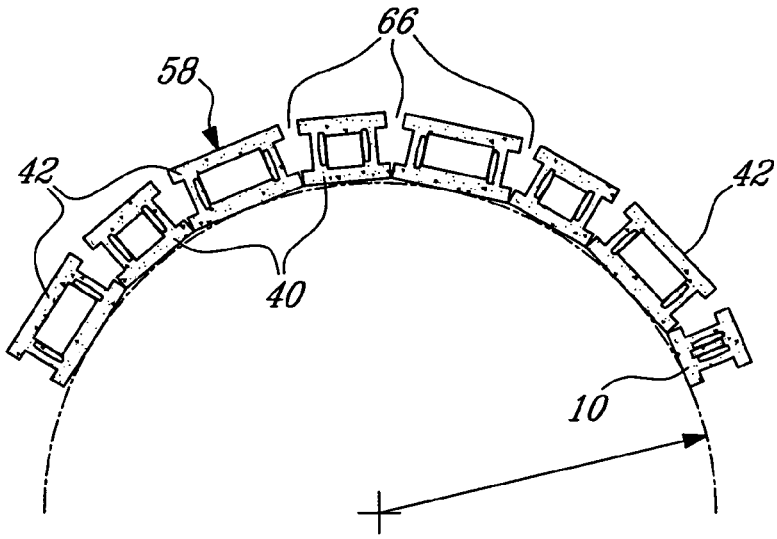
FIG. 11 is a top plan view of a third wall assembly using blocks from FIGS. 1, 3 and 5, resulting in a single side view concave wall.

FIG. 11 illustrates a third wall assembly 58 constructed using blocks 10, 40, 42 and/or any other blocks according to embodiments to the present invention. This third retaining wall construction 58 defines an arc of circle in a single view wall configuration, the concave side of the wall 58 being intended for display. To achieve such a construction 58, the blocks 10, 40 or 42 are positioned so that at least one of the male connector portions 30 and 32 from a first lower row is inserted in hollow core 20" or housing 46 of the next higher row. The dimension of the hollow core 20" is of course sufficient to loosely or snugly receive the male connector portions 30 and 32.

Figure 12:
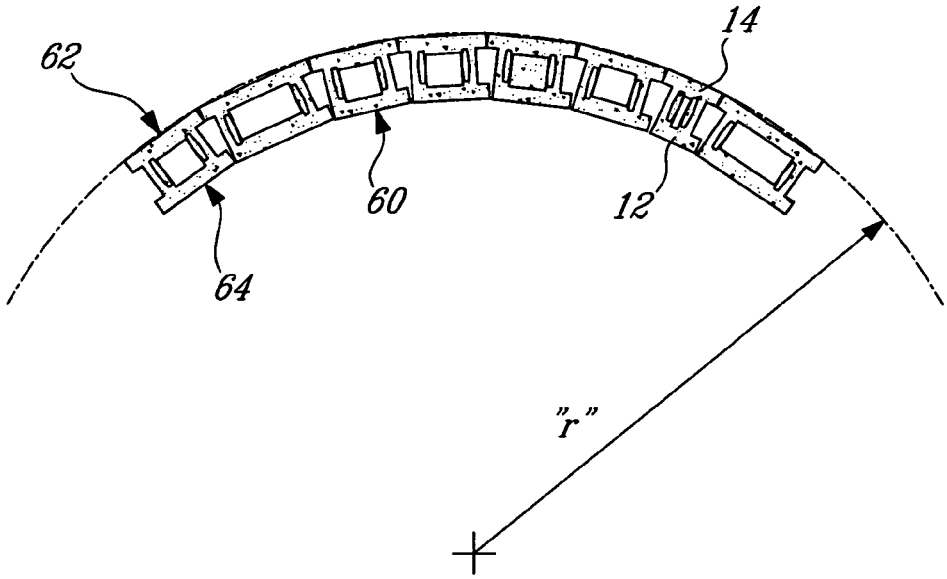
FIG. 12 is a top plan view of a fourth wall assembly using blocks from FIGS. 1, 3 and 5, resulting in a double side view wall.

FIG. 12 illustrates a fourth wall configuration 60. Since the wall construction 60 is similar to the wall construction 58 and for concision purposes, only the differences between the two walls 58 and 60 will be described herein.

The wall 60 is in the form of a double side view wall. Since both sides 62 and 64 of the wall 60 are intended to be viewed, one of the wings of the front wall 12 is removed so as to minimize or prevent the gap 66 between two adjacent blocks 10, 40 and/or 42 on the inner side of the wall 60 (see on FIG. 11). Of course, the wall construction 60 can be used for concave or convex single view walls. The wings can be removed using any well-known methods in the art, such as breakage, shearing, etc.

According to a further embodiment, the front 12 and back 14 walls an/or inner walls 16 and 18 of the block 10, 40 or 42 can be provided with a weak point, for example in the form of a groove (not shown) for example adjacent the intersection of the inner and outer wall allowing to ease the breakage of the wing.

The use of the blocks 10, 40 and 42 will now be further described with reference to FIGS. 14 to 15, which illustrate various retaining wall constructions. These examples will further illustrate the versatility of the blocks 10, 40 and/or 42 and further characteristics and features thereof.

Figure 14:
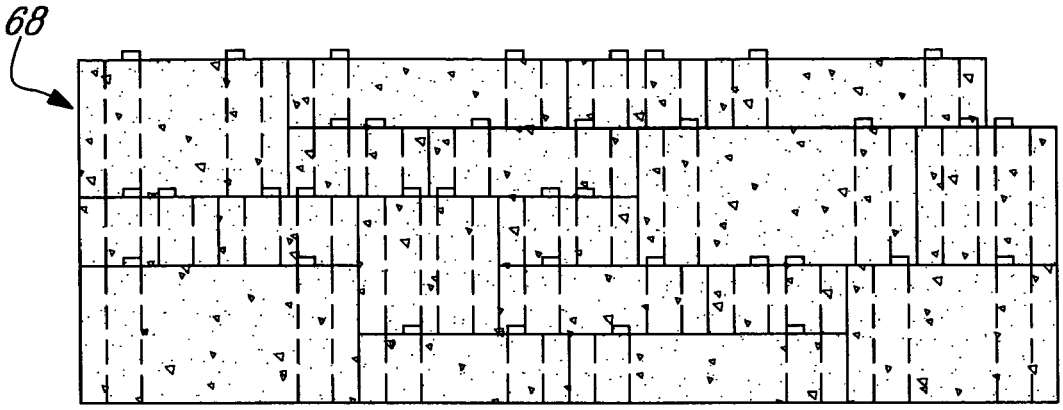
FIGS. 14 and 15 are front elevations of fifth and sixth wall assemblies, FIG. 14 illustrating the use of blocks of different sizes, and FIG. 15 illustrating blocks positioned on the side; both FIGS. 14 and 15 showing ashlar patterned wall constructions.

FIG. 14 illustrates a retaining wall construction 68 made of blocks of various heights, resulting in a well-known ashlar pattern. The construction of such a wall 68 can be facilitated by using various blocks wherein the largest blocks have a height which is the sum of the height of any one(s) of the other smaller blocks. The blocks used are according to embodiments of the present invention and their assembly into the retaining wall construction 68 is as explained hereinabove.

Figure 15:
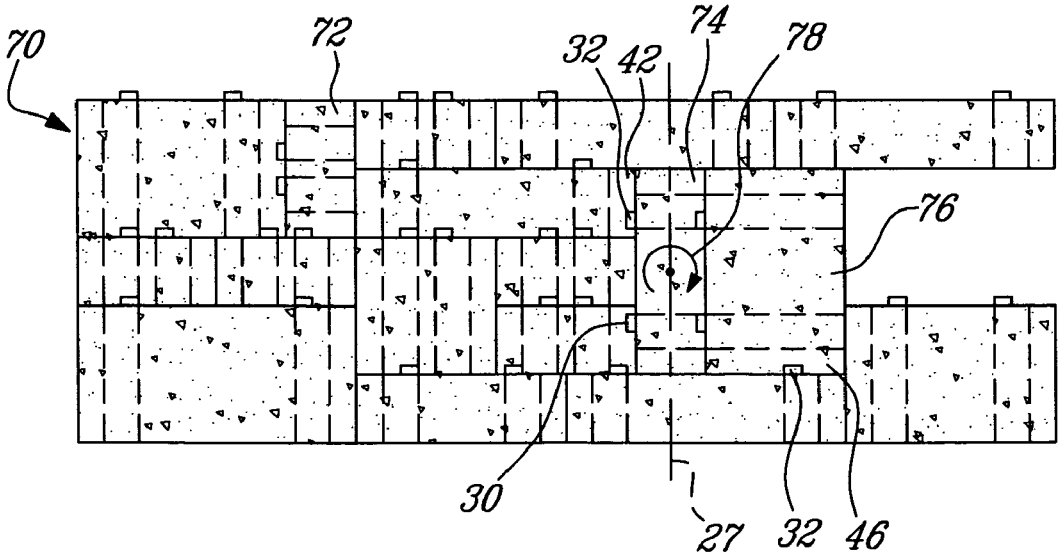
Figure 16:
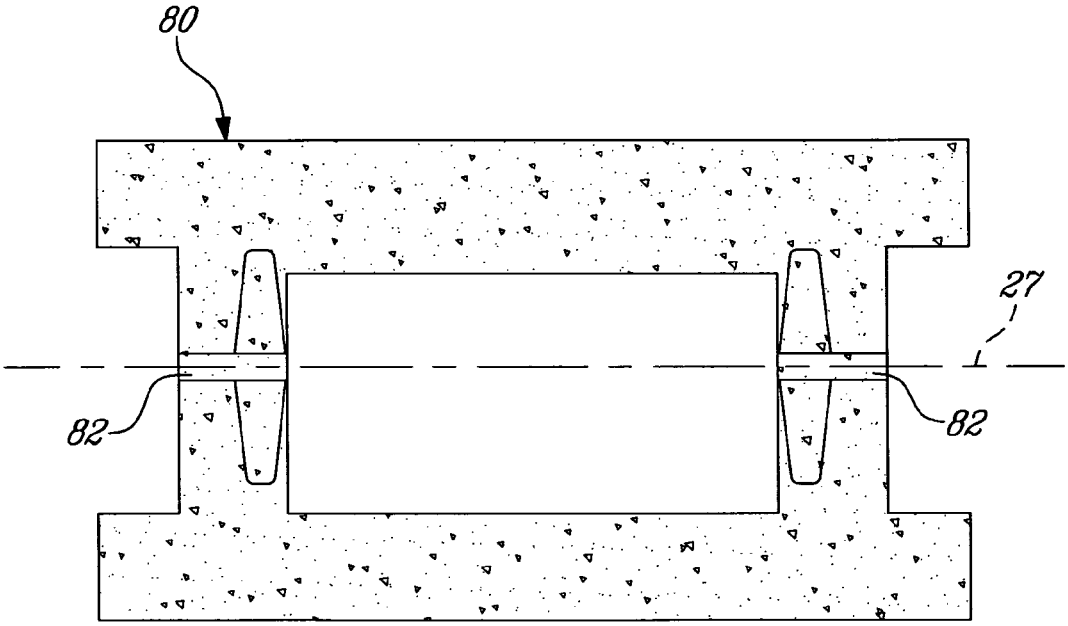
FIG. 16 is a top plan view of a retaining wall block according to a fourth embodiment of the present invention; the block further including a groove for installing a geogrid or a concrete reinforcing bar for bond beams.

Similarly to FIG. 14, FIG. 15 illustrates a retaining wall 70 showing an ashlar pattern. As a difference with the retaining wall 68, the retaining wall 70 includes blocks 72, 74 and 76 which have been pivoted 90 degrees relative to an axis 78 perpendicular to the center axis 27 described hereinabove and parallel to the inner walls. As described also hereinabove, such positioning is facilitated by the insertion of the male connector portions 30 and 32 of the pivoted block in the housing 46 of a block or blocks which is or are adjacent the pivoted block on its side of the male connector portions 30 and 32. On the side of the pivoted block including the female connector portions no coupling is achieved with the adjacent block unless this adjacent block is also pivoted 90 degrees, wherein, in such a case, the coupling is achieved through the male connector portions 30 and 32 and the housing.

Therefore, as a person skilled in the art will now appreciate, the housing defined by the wings and the outer faces of the outer walls, such as the housings 46 in block 10, acts as a projection-receiving element or as a further female connector portion.

A block 80 for retaining walls according to a fourth embodiment of the present invention will now be described with reference to FIGS. 16 and 17A to 17C. Since the block 80 is similar to the blocks 10, 40 and 42, and for concision purposes, only the differences between the block 80 and these blocks 10, 40 and 42 will be described herein.

The block 80, which, similarly to the blocks 10, 40 and 42, can be made in any configuration and sizes, is configured to secure a well-known geogrid 81 thereto.

More specifically, the block 80 includes a groove 82 which extends along the center axis 27 on the top surface 84 of the block 80 and therefore on the two inner walls transversally therefrom. The groove 82 extends from the top surface 84 perpendicularly therefrom typically about 2.5 cm deep.

The width of the groove 82 is such as to allow the groove complementary and fixedly receiving a standard 1.27 cm (0.5 inch) diameter rod 86 and a geogrid semi-wrapped thereabout.

The operation of securing the geogrid 81 to the block 80 using the rod 86 will now be described.

Figure 17A:
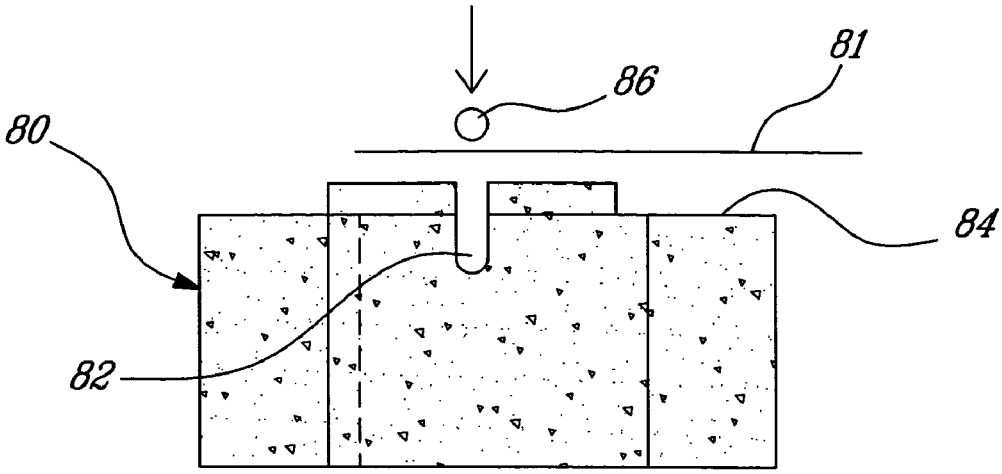
FIGS. 17A-17C are side elevations of the block from FIG. 16, illustrating the attachment of a geogrid thereto.

As illustrated in FIG. 17A, the geogrid 81 is first positioned so as to overlay the block 80 or similar blocks 80.

Figure 17B:
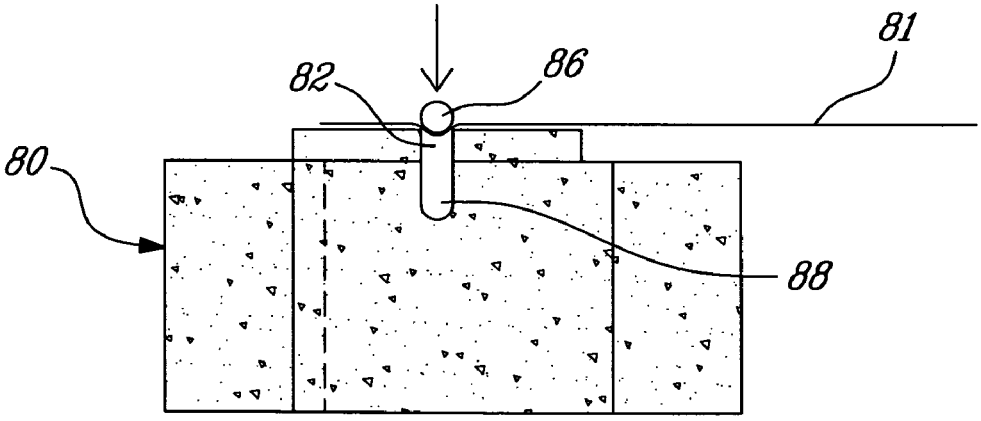
Figure 17C:
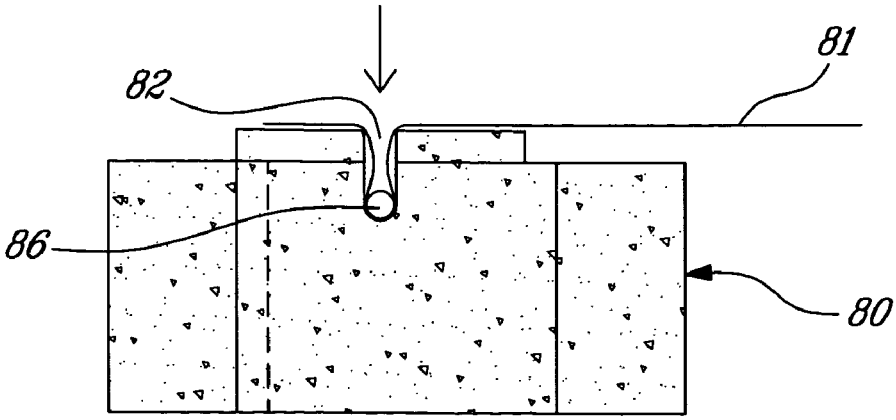

The rod 86 is then inserted in the groove 82 over the geogrid 81 as illustrated in FIG. 17B.

Finally, the rod 86 with the geogrid 81 are pushed to the bottom 88 of the groove 82.

A retaining wall (not shown) constructed with a combination of i) blocks 80 provided with a groove 82 and ii) groove-free blocks, such as for example blocks 10, 40 and 42, can be used to secure a geogrid thereon. The positioning of the grooveted blocks 80 among the other blocks 10, 40 or 42, is such as to allow proper attachment of the geogrid to the wall according to good engineering practice.

Of course, other geogrid securing means can alternatively be used to the rod 86. Also, the groove 82 can have any configuration and size allowing securing a geogrid thereto using a rod, a bar or any other similar means.

The position of the groove 82 is not limited to align with the center axis 27. According to a further embodiment (not shown), the groove is positioned transversally thereof or so as to define an axis therewith.

The block 80 can further be used to receive a portion of a concrete reinforcing bar; wherein such a bar is received in a column formed by a series of consecutive blocks 80 which are part of a wall construction, a bond beam or of any other construction type.

It is to be noted that many modifications can be done to the blocks 10, 40, 42 and 80 for retaining walls, such as without limitations:

- they can be submitted to an aging post-treatment on one or both exposed faces;
- the geometry of the block and the dimensions of its component may vary depending for example on the application;
- the offset "x" of the male and female connector portions towards one of the two outer walls 12 and 14 can be different to the offset that is found on the blocks 10, 40, 42 so as to allow the construction of a wall provided with another offset than the one illustrated in FIG. 8 for example;
- the hollow core and the male connector portions may have any shapes allowing the hollow core receiving the male connector portions therein;
- the hollow core and male connector portions may not be relatively offset;
- according to further embodiments, the front and back walls do not extend beyond the inner walls and the wings are omitted;
- the hollow core does not necessarily extend from the top end side to the bottom end side of the block;
- according to still other embodiments, the inner walls do not extend along the full height of the front and back walls. The male connector portions however extend high enough beyond the front and back walls to cooperatively reach the female connector portions;
- the male connector portions are not limited to having a hexagonal cross-section. Other shapes may be provided including oval and rectangular;
- the female connector portions is not limited to a rectangular cross-section;
- the female connector portions can be in the form of a groove extending from the hollow core;
- the female connector portions can further be in the form of the distal end of the hollow core, the hollow core being tapered;
- the male and female connector portions are configured so as to yield a more or less tight coupling between two adjacent blocks;
- the abutment on the back wall between the two inner walls adjacent the bottom end of the back wall is not limited to a projection thereof extending along the full distance between the two inner walls. It can also be in the form of a smaller projecting element positioned at any location between the two inner walls, more or less near the bottom end of the back wall.

It is to be noted that the male connector portions of the blocks illustrated in FIGS. 13 to 15 have been made visible so as to ease the visualization of their positioning.

Even though the blocks according to the illustrated embodiments of the of the present invention have been described for the construction of retaining walls, they can be used in assembling other types of wall constructions including without limitations sound proof walls and high fences. In some cases, such as for constructing sound proof walls, the rectangular housing between a pair of wing elements can be used to interlock with a column or any other structure.

According to further embodiments of the present invention, corner blocks are provided, which include male and or female portions for connecting with an adjacent retaining wall blocks such as blocks 10, 40, 42 and 80. More generally, such a corner block can be used in a wall construction using blocks according to embodiments of the present invention which include intersection sections.

Even though the blocks according to the described embodiments of the present invention are in the form of a casted one-piece concrete body, a retaining wall block according to another embodiment of the present invention can be assembled from a plurality of parts. Some or all of these parts are made of concrete. The other parts are made for example of a metal or from a composite material. Metal brackets and fasteners are used to assemble the parts.

It is to be understood that the invention is not limited in its applications to the details of construction and parts illustrated in the accompanying drawings and described hereinabove. The invention is capable of other embodiments and of being practiced in various ways. It is also to be understood that the phraseology or terminology used herein is for the purpose of description and not limitation. Hence, although the present invention has been described hereinabove by way of illustrative embodiments thereof, it can be modified, without departing from the spirit, scope and nature of the subject invention as defined in the appended claims.

What is claimed is:

1. A retaining wall block comprising:

front and back walls generally parallel to a first axis and having top and bottom ends; the front and back walls being equally distanced from the first axis; and two inner walls integral to both front and back walls therebetween and that are generally parallel to a second axis which is perpendicular to the first axis; the two inner walls spacing the front and back walls; the two inner walls being distanced so as to yield a hollow core therebetween; the inner walls having facing inner faces, opposite outer faces and a thickness which defines opposite top and bottom end side faces thereof; each of the top side faces of the inner walls having a projection thereon defining a male connector portion; the male connector portion having a first length and being offset a first distance from the first axis towards the back wall;

each of the bottom side faces of the inner walls including a first female connector portion adapted to receive one of the male connector portions;

each first female connector portion being registered along the first axis with a respective one of the male connector portions, having a second length substantially equal to the first length, and being offset the first distance from the first axis towards the front wall; and the back wall having first thickness inside the inner walls; the first thickness is such as to distance the front and back walls within the inner walls from about the first length so that the hollow core defines a second female connector portion adapted to receive one of the male connector portions in a complementary way along the second axis;

the retaining wall block being a first retaining wall block; the male connector portion being for insertion in a one of a respective first female connector portion of a second similar retaining wall block or the second female connector portion thereof when it is mounted onto the retaining wall block so as to yield a straight or a shifted retaining wall portion; the shifted retaining wall portion resulting from the first and second retaining wall blocks having their front walls on a same side relative to the first axis and the straight retaining wall portion resulting from the first and second retaining wall blocks having their front walls on opposite sides relative to the first axis.

2. A retaining wall block as recited in claim 1, wherein the back wall having a second thickness outside the inner walls which is smaller than the first thickness; the second thickness is such as to distance the front and back walls outside the inner walls from a third length substantially equal to the sum of the first distance and of the first length; the front and back walls defining with respective inner walls outside thereof a housing for receiving the projections of a third similar retaining wall block when the third retaining wall block is pivoted 90 degrees about the second axis and mounted adjacent the first retaining wall block in a side-by-side relationship.

3. A retaining wall block as recited in claim 2, wherein a portion of one of the front and back walls on one of the housing includes a weak point at at least one of the top and bottom ends thereof to ease the breakage of said one of the front and back walls at the weak point.

4. A retaining wall block as recited in claim 1, having a top side face defined by at least one of the pair of the front and back walls and the pair of the inner walls; the block further comprising a groove on the top side face for receiving a rod and a geogrid semi-wrapped thereabout the rod.

5. A retaining wall block as recited in claim 1 in the form of a one-piece casted concrete body.

6. A retaining wall block as recited in claim 1, wherein the first female connector portions are shallow holes opening on the hollow core.

7. A retaining wall block as recited in claim 1, wherein the front, back and inner walls are substantially of a same length.

8. A retaining wall block as recited in claim 1, wherein the male connector portions are projections having a hexagonal or rectangular cross-section; the first female connector portions being rectangular holes.

* * * * *

UNITED STATES PATENT AND TRADEMARK OFFICE

CERTIFICATE OF CORRECTION

PATENT NO. : 8,381,478 B2
APPLICATION NO. : 12/925970
DATED : February 26, 2013
INVENTOR(S) : Leach et al.

It is certified that error appears in the above-identified patent and that said Letters Patent is hereby corrected as shown below:

In the Claims:

Claim 1, col. 8, line 61 insert --a-- in-between having and first.

Signed and Sealed this
Fourteenth Day of May, 2013

Teresa Stanek Rea
*Acting Director of the United States Patent and Trademark Office*